US010330352B2

(12) United States Patent
Gurz et al.

(10) Patent No.: US 10,330,352 B2
(45) Date of Patent: Jun. 25, 2019

(54) SELF-HEALING THERMOSTAT HEAT PUMP REVERSING VALVE SETTING

(71) Applicant: Lennox Industries, Inc., Richardson, TX (US)

(72) Inventors: Michael Gurz, Lilburn, GA (US); Timothy Orr, Dunwoody, GA (US); Ron Fisher, Atlanta, GA (US)

(73) Assignee: Advanced Distributor Products LLC, Grenada, MS (US)

( * ) Notice: Subject to any disclaimer, the term of this patent is extended or adjusted under 35 U.S.C. 154(b) by 200 days.

(21) Appl. No.: 15/335,176

(22) Filed: Oct. 26, 2016

(65) Prior Publication Data

US 2018/0112894 A1 Apr. 26, 2018

(51) Int. Cl.
*F25B 13/00* (2006.01)
*F25B 49/02* (2006.01)

(52) U.S. Cl.
CPC ..... *F25B 13/00* (2013.01); *F25B 49/02* (2013.01); *F24F 2221/32* (2013.01); *F25B 2313/027* (2013.01); *F25B 2313/0292* (2013.01)

(58) Field of Classification Search
CPC .... F25B 13/00; F25B 49/02; F25B 2313/027; F25B 2313/0292; F24F 2221/32
See application file for complete search history.

(56) References Cited

U.S. PATENT DOCUMENTS

2012/0130679 A1* 5/2012 Fadell ..... F24F 11/0012 702/183

OTHER PUBLICATIONS

Nest Support "My Heat Pump Cools when it is supposed to be Heating" https://nest.com/support/article/My-heat-pump-cools-when-it-is-supposed-to-be-heating; 3 pages, Printed: Oct. 10, 2016.
User Guide ecobee3 https://www.ecobee.com/wp-content/uploads/2014/09/ecobee3_UserGuide.pdf; 41 pages, 2014.
Lux / Geo Wiring Guide http://luxgeo.com/Wiring-guide.html; 5 pages, Printed Oct. 10, 2016.
*Honeywell Quick Installation Guide* www.youtube.com/watch?v=PRPUAX2U1o0; English and ???? languages 30 pages each, Oct. 10, 2016.
https://www.youtube.com/watch?v=PRPUAX2U1o0, Oct. 10, 2016.

* cited by examiner

*Primary Examiner* — Jonathan Bradford
(74) *Attorney, Agent, or Firm* — Baker Botts L.L.P.

(57) ABSTRACT

In certain embodiments, a controller turns a heat pump system on in heating mode or cooling mode and determines a position for the heat pump system's reversing valve based on an O/B setting. The O/B setting indicates to configure the reversing valve in a first position that causes refrigerant to flow in a first direction when in heating mode and in a second position that causes the refrigerant to flow in a second, opposite direction when in cooling mode. The controller determines whether to maintain or reverse the O/B setting. If the heat pump system heats while in the heating mode or cools while in the cooling mode, the O/B setting is maintained. If the heat pump system cools while in the heating mode or heats while in the cooling mode, the O/B setting is reversed.

17 Claims, 3 Drawing Sheets

SELF-HEALING THERMOSTAT HEAT PUMP REVERSING VALVE SETTING

TECHNICAL FIELD

This application is directed, in general, to heat pump systems, and more specifically to configuring a setting for a reversing valve of a heat pump.

BACKGROUND

Heat pump systems are used for heating and cooling a space, such as a home, an office, or another building. A heat pump system circulates refrigerant. The refrigerant may flow in one direction to provide heating and in the opposite direction to provide cooling. The direction of the refrigerant flow may be controlled by a reversing valve.

SUMMARY

In certain embodiments, a heat pump system comprises a compressor operable to compress refrigerant discharged from an evaporator of the heat pump system; a reversing valve operable to receive the refrigerant from the compressor, circulate the refrigerant through the heat pump system in a first direction when in a first position, and circulate the refrigerant through the heat pump system in a second, opposite direction when in a second position; and a controller operable to turn the heat pump system on according to either a heating mode or a cooling mode and determine a position for the reversing valve based on an O/B setting. The O/B setting indicates to configure the reversing valve in the first position when in the heating mode and in the second position when in the cooling mode. The controller is further operable to determine whether to maintain or reverse the O/B setting. In response to determining that the heat pump system performs heating while in the heating mode or performs cooling while in the cooling mode, the O/B setting is maintained. In response to determining that the heat pump system performs cooling while in the heating mode or performs heating while in the cooling mode, the O/B setting is reversed such that the O/B setting indicates to configure the reversing valve in the first position when in the cooling mode and in the second position when in the heating mode.

To determine whether to maintain or reverse the O/B setting, in certain embodiments the controller is further operable to determine a set point for the heat pump system, record a starting temperature associated with a space being conditioned by the heat pump system, turn the heat pump system on according to the heating mode if the set point is warmer than the starting temperature and according to the cooling mode if the set point is cooler than the starting temperature, determine a current temperature associated with the space being conditioned by the heat pump system, determine to maintain the O/B setting if the current temperature has reached the set point or is closer to the set point than the starting temperature by at least a pre-determined threshold associated with maintaining the O/B setting, and determine to reverse the O/B setting if the current temperature is further from the set point than the starting temperature by more than a pre-determined threshold associated with reversing the O/B setting. The pre-determined threshold associated with maintaining the O/B setting can either be the same as or different from the pre-determined threshold associated with reversing the O/B setting. The current temperature can be determined based on a temperature sensor within the controller and/or a leaving air temperature sensor of the heat pump system. A timer can be used to determine when to determine the current temperature. For example, the timer can be started after determining the set point for the heat pump system and the current temperature is determined in response to expiry of the timer.

In certain embodiments that use a timer, the determination whether to maintain or reverse the O/B setting may be triggered before the timer expires. For example, the trigger condition can occur if a certain temperature threshold is achieved before the timer expires. In one embodiment, if at any point the absolute value of the ([current temperature]−[starting temperature])>Y degrees, the determination whether to maintain or reverse the O/B setting is triggered. If the determination has not been triggered (e.g., if the temperature threshold of Y degrees has not been reached) by the time the timer expires, the temperature may be checked in response to expiry of the timer (e.g., after X minutes). The same temperature threshold (e.g., Y degrees) can be used to evaluate the current temperature both before and after the timer expiry. Alternatively, one temperature threshold can be used to evaluate the current temperature before timer expiry (e.g., Y degrees), and a different temperature threshold can be used to evaluate the current temperature after timer expiry (e.g., Z degrees).

In certain embodiments, the controller is further operable to receive a set point for the heat pump system after having maintained or reversed the O/B setting and to turn on the heating mode or the cooling mode according to normal operation for reaching the set point (the normal operation does not re-determine whether to maintain or reverse the O/B setting).

In certain embodiments, the controller is operable to determine whether to maintain or reverse the O/B setting in response to determining that new equipment (e.g., the controller or one of the other components) has been installed in the heat pump system. In certain embodiments, the controller is operable to determine whether to maintain or reverse the O/B setting in response to a request received from a user input.

Particular embodiments of the present disclosure may provide one or more technical advantages. For example, in certain embodiments a heat pump system can determine an incorrect setting of a reversing valve and automatically correct the setting. Certain embodiments allow for efficient energy utilization and improved user comfort by preventing the heat pump system from using an incorrect setting. Certain embodiments may simplify the installation of new equipment (such as a new controller) in a heat pump system by allowing the system to self-heal when a component is installed with an incorrect configuration. Certain embodiments of the present disclosure may include some, all, or none of these advantages. One or more other technical advantages may be readily apparent to those skilled in the art from the figures, descriptions, and claims included herein.

BRIEF DESCRIPTION

For a more complete understanding of the present disclosure and the advantages thereof, reference is now made to the following Detailed Description taken in conjunction with the accompanying drawings, in which.

DETAILED DESCRIPTION

A heat pump system can be configured to operate in heating mode or cooling mode depending on the direction of the refrigerant flow. The direction of the refrigerant flow depends on the configuration of a reversing valve. The proper configuration of the reversing valve depends on the model or brand of the heat pump system. Most heat pump systems require the reversing valve to be powered in cooling mode. However, some heat pump systems, such as certain systems manufactured by Rheem® and Ruud™, require the reversing valve to be powered in heating mode. In systems using 24V (non-communicating) controls, if the thermostat is not configured during install with the correct setting for the reversing valve operation, the system will heat when set in cooling mode and will cool when set in heating mode. Current thermostats do not possess the logic to sense the cycle is reversed and adapt. In order to correct the reversed cycle in current systems, an installer must change an O/B setting. The O/B setting may be changed by changing a setting on the thermostat, changing a DIP switch, or changing wiring terminals. Embodiments of the present disclosure provide a solution to this problem. For example, certain embodiments allow the thermostat to automatically detect this reversed condition and correct it without user intervention or a service call.

Figure 1:
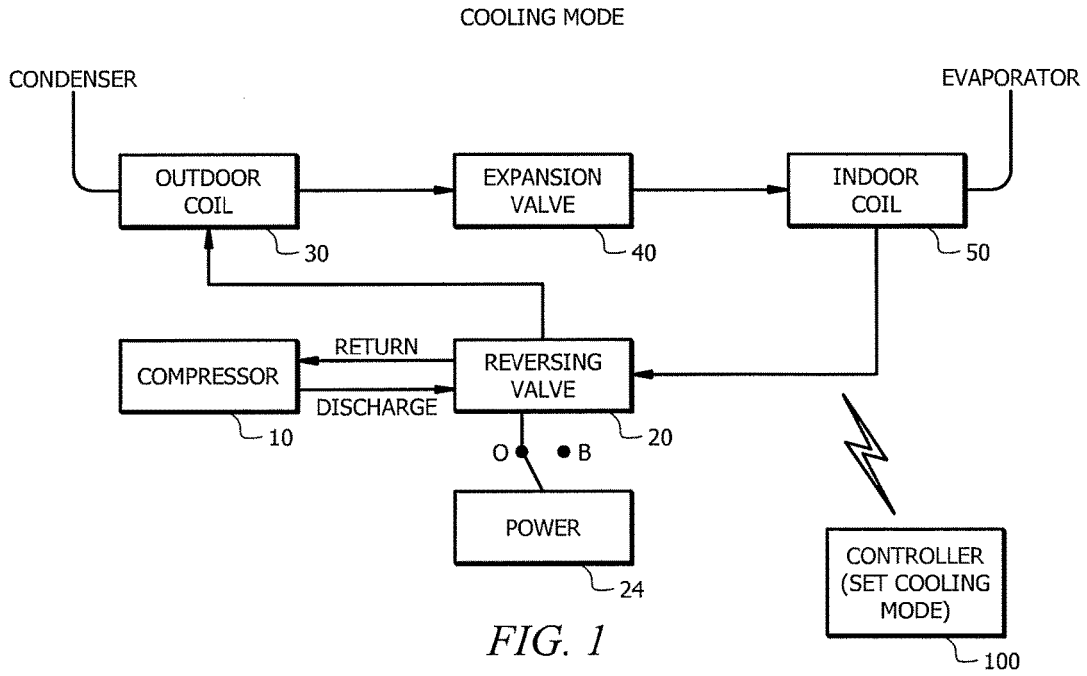
FIG. 1 is an example block diagram of a heat pump system in cooling mode, in accordance with certain embodiments of the present disclosure.
Figure 2:
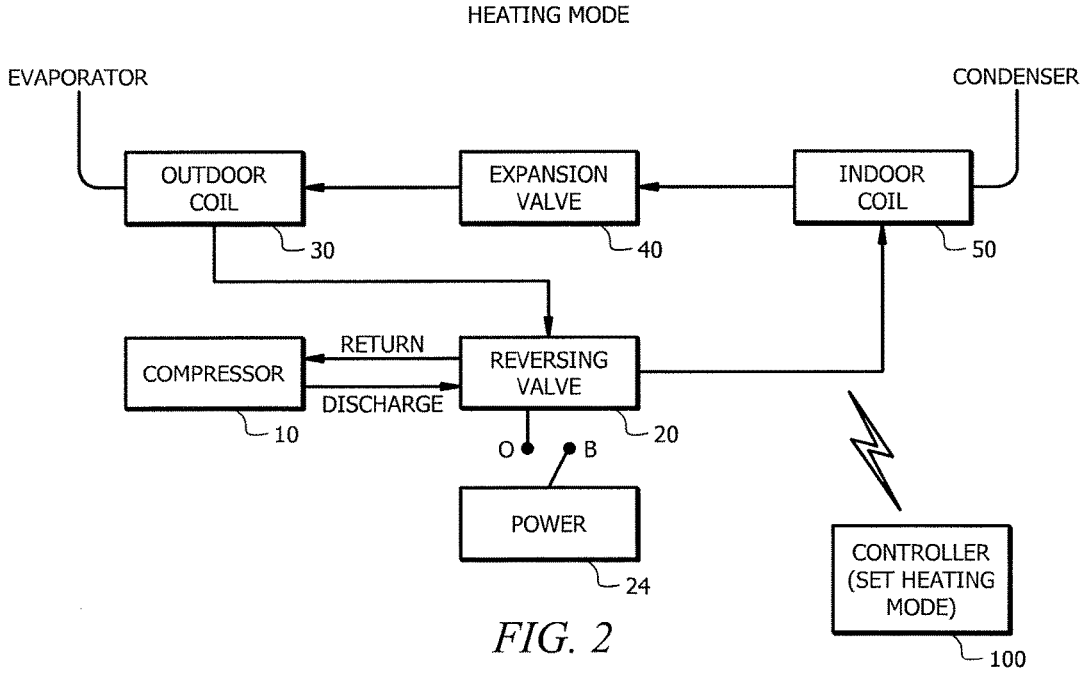
FIG. 2 is an example block diagram of a heat pump system in heating mode, in accordance with certain embodiments of the present disclosure.

FIGS. 1-2 illustrate an example block diagram of a heat pump system comprising a compressor 10, a reversing valve 20, a power source 24, an outdoor coil 30, an expansion valve 40, an indoor coil 50, and a controller 100, in accordance with certain embodiments of the present disclosure. Whether the heat pump system is in cooling mode or heating mode depends on the position of reversing valve 20, as further discussed below.

In FIG. 1, the heat pump system operates in cooling mode. Controller 100 can be used to set the heat pump system in cooling mode. In certain embodiments, setting the heat pump system in cooling mode causes power source 24 to apply a signal (such as a 24 volt signal) to an "O" terminal of the heat pump system. In certain embodiments, applying the signal to the O terminal supplies power to reversing valve 20, which causes reversing valve 20 to open and refrigerant to flow in the cooling direction. For example, refrigerant enters compressor 10 as a vapor. Compressor 10 compresses the vapor and discharges it to reversing valve 20. Reversing valve 20 discharges the compressed vapor to outdoor coil 30. In cooling mode, outdoor coil 30 acts as a condenser that condenses the vapor into a liquid by removing heat. The liquid refrigerant goes through expansion valve 40 where the pressure decreases causing evaporation of a portion of the refrigerant. The mixture of liquid and vapor refrigerant enters indoor coil 50 at a low temperature and pressure. In cooling mode, indoor coil 50 acts as an evaporator that vaporizes the refrigerant by cooling the warm air (from the space being cooled) being blown by a fan across the evaporator coil. The resulting refrigerant vapor returns to compressor 10 via reversing valve 20 and the cycle repeats.

In FIG. 2, the heat pump system operates in heating mode. Controller 100 can be used to set the heat pump system in heating mode. In certain embodiments, setting the heat pump system in heating mode causes power source 24 to apply a signal (such as a 24 volt signal) to a "B" terminal of the heat pump system. In certain embodiments, applying the signal to the B terminal disconnects power from reversing valve 20, which causes reversing valve 20 to close and refrigerant to flow in the heating direction. For example, refrigerant enters compressor 10 as a vapor. Compressor 10 compresses the vapor and discharges it to reversing valve 20. Reversing valve 20 discharges the compressed vapor to indoor cool 50. In heating mode, indoor coil 50 acts as a condenser that condenses the vapor into a liquid by removing heat. The heat removed by indoor coil 50 heats the indoor space. The liquid refrigerant goes through expansion valve 40 where the pressure decreases causing evaporation of a portion of the refrigerant. The mixture of liquid and vapor refrigerant enters outdoor coil 30 at a low temperature and pressure. In heating mode, outdoor coil 30 acts as an evaporator. The resulting refrigerant vapor returns to compressor 10 via reversing valve 20 and the cycle repeats.

The example illustrated in FIGS. 1-2 supplies power to reversing valve 20 for cooling mode and disconnects power from reversing valve 20 for heating mode. Although heat pump systems from most manufacturers generally operate in a manner similar to the system in FIGS. 1-2, this configuration is not mandatory. For example, there is not an industry standard that specifies the configuration for reversing valve 20. As a result, certain manufacturers require supplying power to reversing valve 20 for heating mode, rather than cooling mode.

Problems can occur if reversing valve 20 is powered when it is supposed to be disconnected (or disconnected when it is supposed to be powered). As an example, suppose a homeowner replaces a thermostat but does not properly configure the thermostat for the brand of heat pump in the home. The homeowner turns the thermostat to cool, sets the set point for 62 degrees, and leaves. Because the thermostat is not properly configured, the system applies heating instead of cooling, which means that operating the system inadvertently causes the temperature to move further away from the set point. The system will continuously operate to try to cool the home to the set point. However, because the thermostat is not properly configured, running the system just makes the home hotter and hotter. When the homeowner returns, the home has reached 102 degrees. Embodiments of the present disclosure provide a solution to this problem.

Certain embodiments provide a method for the thermostat to automatically detect when the system runs in heating mode during a call for cooling (or in cooling mode during a call for heating) due to reversing valve 20 having an incorrect O/B setting. Once this condition has been detected, the thermostat can self-correct the erroneous O/B setting, thereby resolving the issue and allowing for correct operation thereafter. In certain embodiments, this may be performed as a one-time test that would occur the first time the thermostat is put into service after all initial settings are made and installation complete.

In certain embodiments, the thermostat would comprise a common O/B terminal, and the determination of whether to energize the terminal on a call for heating or cooling could be made by the thermostat software as part of a setup feature. For example, on the initial call for cooling, the thermostat would monitor the indoor air temperature for a fixed period of time. If after that time period the indoor air is warmer than a fixed amount over the initial temperature, the thermostat reverses the setting for energizing the O/B terminal and runs the test again. If during the fixed time period the call for cooling is satisfied or the room temperature is sufficiently decreasing, the test is complete, because it has been confirmed that the heat pump operates in cooling mode in response to a call for cooling. Similar logic may be applied for an initial call for heating. In certain embodiments, the temperature could be determined using a leaving air temperature sensor (if installed) or an indoor air temperature sensor (such as a sensor at the thermostat) to determine if the system is heating during a call for cooling (or cooling during a call for heating). Although the example has described applying the logic as a test after installation is complete, in another embodiment, the logic could be integrated into an automated setup routine.

Referring back to FIG. 1, the system is illustrated as responding to a cooling demand from controller 100 by connecting power source 24 to the O terminal, thereby supplying power to reversing valve 20. If it is determined that the heat pump system is of a manufacture for which reversing valve 20 is supposed to be powered during heating mode (rather than cooling mode), an O/B setting could be configured to flip operation of the switch so that power source 24 supplies power to reversing valve 20 when controller 100 is placed in heating mode.

Figure 3:
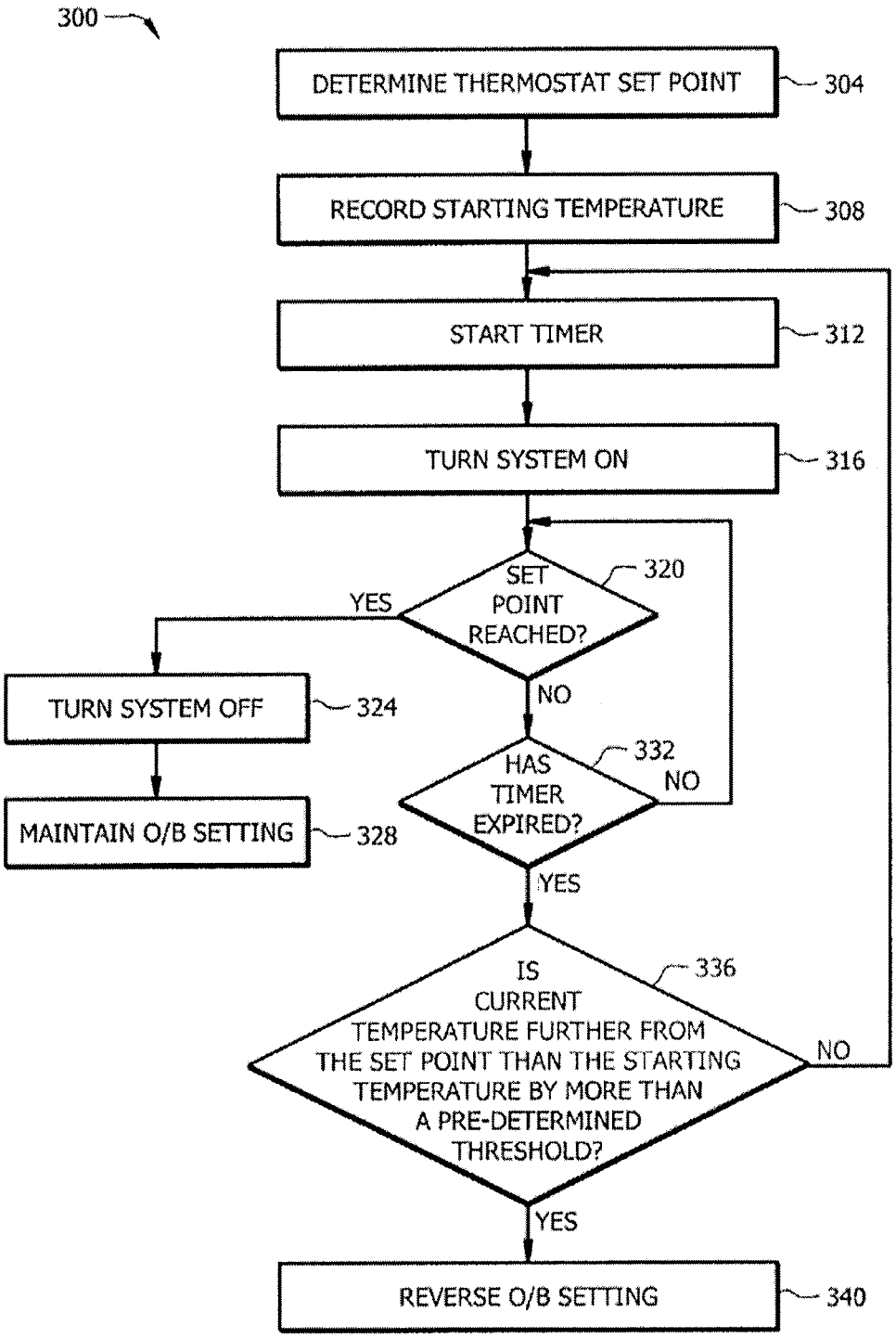
FIG. 3 is an example flow chart illustrating a method of configuring a setting for a reversing valve of a heat pump system, in accordance with certain embodiments of the present disclosure.

FIG. 3 is an example flow chart illustrating a method of configuring a setting for a reversing valve of a heat pump, in accordance with certain embodiments of the present disclosure. In general, the method begins by determining a thermostat set point (step 304), recording a starting temperature (step 308), starting a timer (step 312), and turning the system on (step 316). If the set point is reached (step 320), the system is turned off (step 324) and the O/B setting is maintained (step 328). However, if the set point has not been reached by the time that the timer expires (step 332), the method proceeds to step 336 where a determination is made whether the current temperature is further from the set point than the starting temperature by more than a pre-determined threshold.

If at step 336 the current temperature is further from the set point by more than the pre-determined threshold, the method proceeds to step 340 where the O/B setting is reversed. Thus, a controller and/or other component(s) of a heat pump system that perform the method can automatically detect and reverse an incorrect O/B setting without a user (such as a homeowner or service person) having to change a dip switch, a wiring terminal, or an O/B setting on the thermostat. If at step 336 the current temperature is not further from the set point by more than the pre-determined threshold, in certain embodiments, the method returns to step 312 where the timer is reset and the temperature continues to be monitored until the temperature either reaches the set point (in which case the method maintains the O/B setting) or has moved further from the set point by more than a pre-determined threshold (in which case the method reverses the O/B setting).

The method of FIG. 3 may be applied when meeting a cooling demand or a heating demand. The steps of FIG. 3 are further described with respect to Examples 1-4 below. Example 1 describes a scenario in which the heat pump system is in cooling mode and is operating with a correct O/B setting. Example 2 describes a scenario in which the heat pump system is in cooling mode and is operating with an incorrect O/B setting. Example 3 describes a scenario in which the heat pump system is in heating mode and is operating with a correct O/B setting. Example 4 describes a scenario in which the heat pump system is in heating mode and is operating with an incorrect O/B setting.

In Example 1, the heat pump system is in cooling mode and is operating with a correct O/B setting. At step 304, the method receives a thermostat set point. As an example, the thermostat set point may be 70° F. In certain embodiments, the set point may be input by an operator. In other embodiments, the set point may be automatically configured by controller 100. For example, controller 100 may be configured to run an O/B test in response to detecting the installation of new equipment (such as a thermostat and/or a heat pump) or in response to a request from an operator. In certain embodiments, the O/B test may configure the set point at least a pre-determined amount less than the starting temperature to ensure that changes in temperature are due to operation of the heat pump system, as opposed to fluctuations in the ambient weather or some other reason.

At step 308, the method records a starting temperature. In certain embodiments, the temperature may be determined based on information from one or more sensors located within the indoor space being conditioned by the heat pump system or located at a point where the air leaves the heat pump system (leaving air temperature sensor). As an example, the starting temperature may be 75° F.

At step 312, the method starts a timer. The value of the timer may be approximately the amount of time that would likely be needed to cool the indoor space from the starting temperature to the thermostat set point. In certain embodiments, the timer may be set to a value within the range of 1 minute to 30 minutes. In other embodiments, the timer may be set to any other suitable value. The timer value may be determined according to a pre-defined setting or a pre-defined rule. One rule might increase the timer value as the difference between the starting temperature and the set point increases. At step 316, the system is turned on in what is assumed to be cooling mode according to the current O/B setting.

At step 320, it is determined whether the set point has been reached. In an embodiment of Example 1, the set point is reached when the one or more sensors indicate that the current temperature within the indoor space (i.e., the space being conditioned by the heat pump system) is less than or equal to the 70° F. set point. If the set point has been reached, the method turns the system off at step 324 (i.e., turns off cooling) and maintains the O/B setting at step 328. The O/B setting is maintained because it correctly caused the heat pump system to cool the indoor temperature in response to a request for cooling. If the indoor temperature subsequently drifts above the thermostat set point, the system may be turned back on to resume cooling according to normal operation of the heat pump system. If the system needs to change from cooling mode to heating mode, for example, in response to a change in the thermostat set point, the reversing valve can manage the change according to its normal operation without having to reconfigure the O/B setting.

If at step 320 the set point has not been reached, the method proceeds to step 332 to determine if the timer has expired. If the timer has not expired, the method returns to step 320 to check whether the set point has been reached. If the timer has expired, the method proceeds to step 336 where it is determined whether the current temperature is further from the set point than the starting temperature by more than a pre-determined threshold. As an example, suppose the current temperature is 72° F., which means the current temperature is 2° F. from the set point of 70° F. Recall that in this Example 1, the starting temperature was 75° F., which is 5° F. from the set point). Thus, the current temperature is closer to the set point than the starting temperature. Because the temperature is moving in the correct direction (even though the set point has not yet been reached), the method returns to step 312 to restart the timer and continue cooling for a period of time. In Example 1, the O/B setting is correct, so the set point will eventually be reached.

In certain embodiments, the test at step 336 is based on a pre-determined threshold. The pre-determined threshold may be configured to avoid inadvertently reversing the O/B setting when the reason for the temperature moving in the wrong direction is not an incorrect O/B setting. Continuing with Example 1, even though the heat pump system is correctly providing cool air while in cooling mode, the current temperature may be slightly warmer than the starting temperature due to a margin of error in the sensors, due to sun exposure/warmer ambient weather that makes the system have to work harder to maintain a cool temperature, or due to some other factor. The pre-determined threshold can be configured so that small fluctuations in the wrong direction do not cause the O/B setting to be reversed. In certain embodiments, the pre-determined threshold may be a value in the range of 5° F. to 15° F., or any other suitable value. Continuing with Example 1, suppose the pre-determined threshold is 10° F. This would mean that if the current temperature is less than or equal to 85° F. (i.e., the starting temperature of 75° F. plus the pre-determined threshold of 10° F.), the result of the test at step 336 would be to return to step 312. Returning to step 312 allows more time for the heat pump system to eventually reach the thermostat set point. Because the heat pump system is correctly cooling while in cooling mode, the O/B setting is maintained.

In Example 2, the heat pump system is in cooling mode and is operating with an incorrect O/B setting. At step 304, the method receives a thermostat set point (e.g., 70° F.). At step 308, the method records a starting temperature (e.g., 75° F.). At step 312, the method starts the timer. At step 316, the heat pump system is turned on in what is assumed to be cooling mode according to the current O/B setting. At step 320, it is determined whether the set point has been reached. Because the O/B setting is incorrect in Example 2, the heat pump system is actually heating when it is assumed to be in cooling mode. Thus, the set point will not be reached at step 320. After the timer expires (step 332), the method proceeds to step 336 to determine if the current temperature is further from the set point than the starting temperature (e.g., 75° F.) by more a pre-determined amount (e.g., 10° F.). Thus, in this example, the method determines if the current temperature is greater than 85° F. If yes, it indicates that the heat pump system is incorrectly heating while in cooling mode, so the O/B setting is reversed at step 340. If no, the method returns to step 312 to restart the timer and allow more time to determine which direction the temperature is actually moving when the heat pump system is running in what is assumed to be cooling mode according to the current O/B setting.

In Example 3, the heat pump system is in heating mode and is operating with a correct O/B setting. At step 304, the method receives a thermostat set point (e.g., 75° F.). At step 308, the method records a starting temperature (e.g., 70° F.). At step 312, the method starts the timer. At step 316, the system is turned on in what is assumed to be heating mode according to the current O/B setting. At step 320, it is determined whether the set point has been reached. If yes, the method proceeds to turn the heat pump system off at step 324 (e.g., stop heating when the temperature reaches the 75° F. set point). The fact that the heat pump system heated the temperature while in heating mode indicates that the O/B setting is correct. Thus, the method proceeds to step 328 where the O/B setting is maintained.

If the set point had not yet been reached at step 320 and the timer expired at step 332, the method would proceed to step 336 to determine if the current temperature is further from the set point (e.g., 75° F.) than the starting temperature (70° F.) by more than a pre-determined threshold (e.g., 10° F.). In other words, in the case of Example 3, a determination is made whether the current temperature is less than 60° F. Suppose that the current temperature is 72° F. The method would return to step 312 to restart the timer and allow more time to reach the set point. Because the O/B setting is correct in Example 3, the heat pump system is heating while in heating mode and the set point will eventually be reached. Thus, the O/B setting will be maintained.

In Example 4, the heat pump system is in heating mode and is operating with an incorrect O/B setting. At step 304, the method receives a thermostat set point (e.g., 75° F.). At step 308, the method records a starting temperature (e.g., 70° F.). At step 312, the method starts the timer. At step 316, the system is turned on in what is assumed to be heating mode according to the current O/B setting. At step 320, it is determined whether the set point has been reached. Because the O/B setting is incorrect in Example 4, the heat pump system is actually cooling when it is assumed to be in heating mode. Thus, the set point will not be reached at step 320. After the timer expires (step 332), the method proceeds to step 336 to determine if the current temperature is further from the set point than the starting temperature (e.g., 70° F.) by more a pre-determined amount (e.g., 10° F.). Thus, in this example, the method determines if the current temperature is less than 60° F. If yes, it indicates that the heat pump system is incorrectly cooling while in heating mode, so the O/B setting is reversed at step 340. If no, the method returns to step 312 to restart the timer and allow more time to determine which direction the temperature is actually moving when the heat pump system is running in what is assumed to be heating mode according to the current O/B setting.

The preceding examples describe certain set points, temperatures, and thresholds for the purpose of description and explanation, however, any suitable values may be used. For simplicity the preceding examples have been described as checking to see if the set point is reached (step 320). In other embodiments, step 320 may comprise any suitable step to sufficiently confirm that operating the heat pump system causes temperature to move in the correct direction. As an example, step 320 may check whether the current temperature of the system operating in what is assumed to be cooling mode is cooler than the starting temperature by at least a pre-determined threshold. Similarly, step 320 may check whether the current temperature of the system operating in what is assumed to be heating mode is warmer than the starting temperature by at least a pre-determined threshold.

Figure 4:
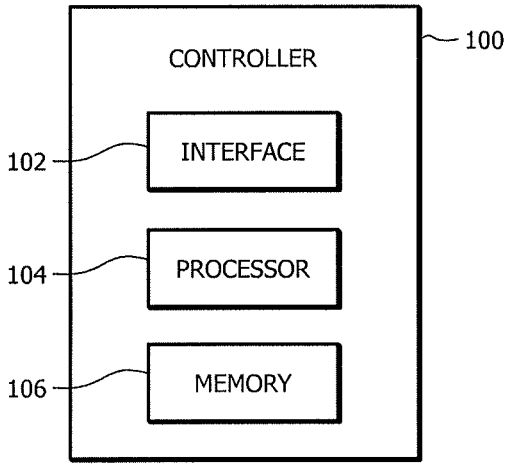
FIG. 4 is an example block diagram of a controller for a heat pump system, in accordance with certain embodiments of the present disclosure.

FIG. 4 is an example block diagram of a controller 100 for a heat pump system, such as controller 100 described with respect to FIGS. 1-2, in accordance with certain embodiments of the present disclosure. In certain embodiments, controller 100 may comprise a thermostat or may comprise a separate controller which may be in communication with a thermostat. Controller 100 comprises one or more interface(s) 102, processor(s) 104, and memory 106.

In some embodiments, interface 102 facilitates communicating signals to/from components of the heat pump system, processor 104 executes instructions to provide some or all of the control functionality for the heat pump system, and memory 106 stores the instructions for execution by processor 104. As an example, processor 104 may determine a thermostat set point based on an input received from interface 102, determine to turn components of the heat pump system on or off based on instructions and/or configuration settings stored in memory 106, and communicate signals via interface 102 to cause the components of heat pump system 100 to turn on or off, for example, in order to reach the set point. In certain embodiments, processor 100 may perform the method described with respect to FIG. 3 in order to determine whether to maintain or reverse an O/B setting. Certain embodiments use the term O/B setting in a general sense to refer to the setting(s) that configure the direction that refrigerant flows through reversing valve 20.

Interface 102 may comprise a wired or wireless interface and may be configured to communicate with components of the heat pump system through any suitable network. Processor 104 may include any suitable combination of hardware and software implemented in one or more modules to execute instructions and manipulate data to perform some or all of the described functions. In some embodiments, processor 104 may include, for example, one or more computers, one or more central processing units (CPUs), one or more microprocessors, one or more applications, one or more application specific integrated circuits (ASICs), one or more field programmable gate arrays (FPGAs) and/or other logic.

Memory 106 is generally operable to store instructions, such as a computer program, software, an application including one or more of logic, rules, algorithms, code, tables, etc. and/or other instructions capable of being executed by a processor. Examples of memory include computer memory (for example, Random Access Memory (RAM) or Read Only Memory (ROM)), mass storage media (for example, a hard disk), removable storage media (for example, a Compact Disk (CD) or a Digital Video Disk (DVD)), and/or or any other volatile or non-volatile, non-transitory computer-readable and/or computer-executable memory devices that store information, data, and/or instructions that may be used by processor 104 of controller 100.

Other embodiments of controller 100 may include additional components beyond those shown in FIG. 4 that may be responsible for providing certain aspects of the controller's functionality, including any of the functionality described above and/or any additional functionality (including any functionality necessary to support the solution described above). As just one example, controller 100 may include input devices and output devices. Input devices include mechanisms for entry of data into controller 100. For example, input devices may include input mechanisms, such as a microphone, input elements, a display, a keyboard, etc. Output devices may include mechanisms for outputting data in audio, video, and/or hard copy format. For example, output devices may include a speaker, a display, etc.

Although several embodiments have been illustrated and described in detail, it will be recognized that substitutions and alterations are possible without departing from the spirit and scope of the present disclosure, as defined by the claims. Modifications, additions, or omissions may be made to the systems, apparatuses, and processes described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic. The methods may include more, fewer, or other steps, and the steps may be performed in any suitable order. As used in this document, "each" refers to each member of a set or each member of a subset of a set.

The invention claimed is:

1. A heat pump system, comprising:

a compressor operable to compress refrigerant discharged from an evaporator of the heat pump system;

a reversing valve operable to:

receive the refrigerant from the compressor;

circulate the refrigerant through the heat pump system in a first direction when the reversing valve is in a first position; and circulate the refrigerant through the heat pump system in a second direction when the reversing valve is in a second position, the second direction opposite the first direction; and a controller comprising a processor and memory, the controller configured to:

determine a starting temperature for a space;

configure a thermostat with a set point, wherein the set point is at least a set amount of degrees from the starting temperature;

set a timer, wherein the timer is set to a time based on a difference between the starting temperature and the set point;

turn the heat pump system on in either a heating mode or a cooling mode, comprising:

turning the heat pump system on in a heating mode when the set point is warmer than the starting temperature; and turning the heat pump system on in a cooling mode when the set point is cooler than the starting temperature;

determine a position for the reversing valve based on an O/B setting, wherein the O/B setting indicates to configure the reversing valve in the first position when in the heating mode and in the second position when in the cooling mode;

determine if the timer has expired;

determine whether to maintain or reverse the O/B setting in response to determining the timer has expired, wherein:

in response to determining that the heat pump system performs heating while in the heating mode or performs cooling while in the cooling mode, the O/B setting is maintained; and in response to determining that the heat pump system performs cooling while in the heating mode or performs heating while in the cooling mode, the O/B setting is reversed such that the O/B setting indicates to configure the reversing valve in the first position when in the cooling mode and in the second position when in the heating mode.

2. The heat pump system of claim 1, wherein the controller is configured to determine whether to maintain or reverse the O/B setting in response to determining that new equipment has been installed in the heat pump system.

3. The heat pump system of claim 1, wherein to determine whether to maintain or reverse the O/B setting, the controller is further configured to:

determine a current temperature associated with the space being conditioned by the heat pump system;

determine to maintain the O/B setting if the current temperature has reached the set point or is closer to the set point than the starting temperature by at least a pre-determined threshold associated with maintaining the O/B setting; and determine to reverse the O/B setting if the current temperature is further from the set point than the starting temperature by more than a pre-determined threshold associated with reversing the O/B setting.

4. The heat pump system of claim 3, wherein the current temperature is determined based on a temperature sensor within the controller or a leaving air temperature sensor of the heat pump system.

5. The heat pump system of claim 1, the controller further configured to:

receive a second set point for the heat pump system after having maintained or reversed the O/B setting; and turn on the heating mode or the cooling mode according to normal operation for reaching the second set point, wherein the normal operation does not re-determine whether to maintain or reverse the O/B setting.

6. The heat pump system of claim 1, wherein the controller is configured to determine whether to maintain or reverse the O/B setting in response to a request received from a user input.

7. A controller for a heat pump system, the controller comprising:

one or more processors and non-transitory computer readable memory, the one or more processors operable to execute instructions stored on the memory, whereby the controller is configured to:

determine a starting temperature for a space;

configure a thermostat with a set point, wherein the set point is at least a set amount of degrees from the starting temperature;

set a timer, wherein the timer is set to a time based on a difference between the starting temperature and the set point;

turn the heat pump system on in either a heating mode or a cooling mode, comprising:

turning the heat pump system on in a heating mode when the set point is warmer than the starting temperature; and turning the heat pump system on in a cooling mode when the set point is cooler than the starting temperature;

determine a position for a reversing valve of the heat pump system based on an O/B setting, wherein the O/B setting indicates to configure the reversing valve in a first position that causes refrigerant to flow in a first direction when in the heating mode and in a second position that causes the refrigerant to flow in a second, opposite direction when in the cooling mode;

determine if the timer has expired;

determine whether to maintain or reverse the O/B setting in response to determining that the timer has expired, wherein:

in response to determining that the heat pump system performs heating while in the heating mode or performs cooling while in the cooling mode, the O/B setting is maintained; and in response to determining that the heat pump system performs cooling while in the heating mode or performs heating while in the cooling mode, the O/B setting is reversed such that the O/B setting indicates to configure the reversing valve in the first position when in the cooling mode and in the second position when in the heating mode.

8. The controller of claim 7, wherein the controller is configured to determine whether to maintain or reverse the O/B setting in response to determining that new equipment has been installed in the heat pump system.

9. The controller of claim 7, wherein to determine whether to maintain or reverse the O/B setting, the controller is further configured to:

determine a current temperature associated with the space being conditioned by the heat pump system;

determine to maintain the O/B setting if the current temperature has reached the set point or is closer to the set point than the starting temperature by at least a pre-determined threshold associated with maintaining the O/B setting; and determine to reverse the O/B setting if the current temperature is further from the set point than the starting temperature by more than a pre-determined threshold associated with reversing the O/B setting.

10. The controller of claim 9, wherein the current temperature is determined based on a temperature sensor within the controller or a leaving air temperature sensor of the heat pump system.

11. The controller of claim 7, the controller further configured to:

receive a second set point for the heat pump system after having maintained or reversed the O/B setting; and turn on the heating mode or the cooling mode according to normal operation for reaching the second set point, wherein the normal operation does not re-determine whether to maintain or reverse the O/B setting.

12. The controller of claim 7, wherein the controller is configured to determine whether to maintain or reverse the O/B setting in response to a request received from a user input.

13. A non-transitory computer readable memory comprising instructions that, when executed by one or more processors, cause the one or more processors to:

determine a starting temperature for a space;

configure a thermostat with a set point, wherein the set point is at least a set amount of degrees from the starting temperature;

set a timer, wherein the timer is set to a time based on a difference between the starting temperature and the set point;

turn a heat pump system on in either a heating mode or a cooling mode, comprising:

turning the heat pump system on in a heating mode when the set point is warmer than the starting temperature; and turning the heat pump system on in a cooling mode when the set point is cooler than the starting temperature;

determine a position for a reversing valve of the heat pump system based on an O/B setting, wherein the O/B setting indicates to configure the reversing valve in a first position that causes refrigerant to flow in a first direction when in the heating mode and in a second position that causes the refrigerant to flow in a second, opposite direction when in the cooling mode;

determine if the timer has expired;

determine whether to maintain or reverse the O/B setting in response to determining the timer has expired, wherein:

in response to determining that the heat pump system performs heating while in the heating mode or perforins cooling while in the cooling mode, the O/B setting is maintained; and in response to determining that the heat pump system performs cooling while in the heating mode or performs heating while in the cooling mode, the O/B setting is reversed such that the O/B setting indicates to configure the reversing valve in the first position when in the cooling mode and in the second position when in the heating mode.

14. The non-transitory computer readable memory of claim 13, wherein the instructions further cause the one or more processors to determine whether to maintain or reverse the O/B setting in response to determining that new equipment has been installed in the heat pump system.

15. The non-transitory computer readable memory of claim 13, wherein to determine whether to maintain or reverse the O/B setting, the instructions further cause the one or more processors to:

determine a current temperature associated with the space being conditioned by the heat pump system;

determine to maintain the O/B setting if the current temperature has reached the set point or is closer to the set point than the starting temperature by at least a pre-determined threshold associated with maintaining the O/B setting; and determine to reverse the O/B setting if the current temperature is further from the set point than the starting temperature by more than a pre-determined threshold associated with reversing the O/B setting.

16. The non-transitory computer readable memory of claim 15, wherein the current temperature is determined based on a temperature sensor within a thermostat located in the space being conditioned by the heat pump system or a leaving air temperature sensor of the heat pump system.

17. The non-transitory computer readable memory of claim 13, the instructions further cause the one or more processors to:

receive a second set point for the heat pump system after having maintained or reversed the O/B setting; and turn on the heating mode or the cooling mode according to normal operation for reaching the second set point, wherein the normal operation does not re-determine whether to maintain or reverse the O/B setting.

* * * * *